US006382481B1

(12) United States Patent
McIlmoil

(10) Patent No.: US 6,382,481 B1
(45) Date of Patent: May 7, 2002

(54) RETRACTABLE ARTICLE HOLDER

(76) Inventor: Caroline Jo McIlmoil, 9316 Raintree La., Charlotte, NC (US) 28277

( * ) Notice: Subject to any disclaimer, the term of this patent is extended or adjusted under 35 U.S.C. 154(b) by 11 days.

(21) Appl. No.: 09/715,315

(22) Filed: Nov. 17, 2000

(51) Int. Cl.[7] ..... A45F 5/00

(52) U.S. Cl. ..... 224/162; 224/197; 224/677; 224/245; 224/251; 224/901.8; D27/144

(58) Field of Search ..... 224/162, 197, 224/199, 676, 677, 245, 901.8, 251, 254, 255; 24/3.13, 3.9; D27/144, 142; D3/208, 212; 242/588.1; 70/456 R, 457

(56) References Cited

U.S. PATENT DOCUMENTS

| | | | | | |
|---|---|---|---|---|---|
| 1,281,299 | A | * | 10/1918 | Crosson | 224/673 |
| 1,567,783 | A | * | 12/1925 | Best | 224/162 |
| 2,248,338 | A | | 7/1941 | Castleman | |
| 2,589,260 | A | * | 3/1952 | Jablon | 24/116 A |
| 2,653,038 | A | * | 9/1953 | Dyer | 206/39.5 |
| 2,737,036 | A | | 3/1956 | Simpson | |
| D206,983 | S | * | 2/1967 | Knight | 224/236 |
| 3,852,982 | A | * | 12/1974 | Faris | 70/457 |
| 4,082,496 | A | | 4/1978 | Johnson | |
| 4,166,489 | A | * | 9/1979 | Lemelson | 206/38.1 |
| 4,176,773 | A | | 12/1979 | Wilkinson | |
| 4,230,224 | A | | 10/1980 | Weeks | |
| 4,363,432 | A | | 12/1982 | Warthen | |
| 4,486,169 | A | | 12/1984 | Lewis | |
| 4,745,661 | A | | 5/1988 | Wainscott | |
| D297,771 | S | * | 9/1988 | Thomas | 224/255 |
| D298,781 | S | * | 12/1988 | Thomas | 224/255 |
| 4,884,730 | A | * | 12/1989 | Carpenter | 135/66 |
| 4,898,532 | A | | 2/1990 | Bercik | |
| 4,927,354 | A | | 5/1990 | Sanford | |
| D311,599 | S | * | 10/1990 | Braden | D27/142 |
| 5,026,274 | A | | 6/1991 | Jacob | |
| D320,669 | S | * | 10/1991 | Panaggio | D27/144 |
| 5,271,730 | A | | 12/1993 | Acacio da Silva | |
| 5,462,212 | A | * | 10/1995 | Hertel, Jr. | 206/86 |
| 5,497,818 | A | | 3/1996 | Marcarelli | |
| D373,442 | S | | 9/1996 | Thomas | |
| D376,871 | S | * | 12/1996 | Sanchez et al. | D27/183 |
| 5,682,981 | A | * | 11/1997 | Sudborough | 206/349 |
| 5,769,212 | A | * | 6/1998 | Collins | 206/37 |
| 5,788,478 | A | | 8/1998 | DeNoia et al. | |
| D402,401 | S | | 12/1998 | Duke | |
| 5,850,754 | A | * | 12/1998 | Dobbins | 206/305 |
| 6,196,382 | B1 | * | 3/2001 | Lenderman | 206/37 |

* cited by examiner

*Primary Examiner*—Gregory M. Vidovich
(74) *Attorney, Agent, or Firm*—Summa & Allan, P.A.

(57) ABSTRACT

A retractable article holder assembly for use preferably in conjunction with a disposable cigarette lighter comprises in one embodiment an article holder for securing a disposable cigarette lighter, a support housing, a retraction mechanism mounted within the support housing comprising a spring-biased reel for extracting and retracting a cord secured at a first end thereto, a clip secured to one side of the support housing for attaching the housing to an object, and a fastener strap for connecting the article holder to the retraction mechanism. A plurality of protrusions is provided in an interior portion of the article container for preventing movement of the article relative to the article holder. Advantageously, a tongue integral with the article holder extends away from an open end of the article holder at an acute angle relative to the longitudinal axis of the article holder such that the angle of the tongue permits an operator to activate the cigarette lighter and light an item without interference from the body of the article holder or associated fastener strap and retraction mechanism.

30 Claims, 1 Drawing Sheet

RETRACTABLE ARTICLE HOLDER

FIELD OF THE INVENTION

The invention relates to an apparatus for retaining a variety of relatively small, personal articles. In particular, the invention relates to a retractable article holder assembly for use in conjunction with a disposable cigarette lighter.

BACKGROUND OF THE INVENTION

Cigarette lighters are used for a variety of purposes by smokers and non-smokers alike. Disposable cigarette lighters are popular because they are inexpensive, easy to use (i.e., no refilling of fuel or flint), and come in a variety of shapes, sizes, and colors. Smokers typically carry the small disposable lighters on their person. Currently, there are approximately 45.8 million smokers in the United States of America between the ages of 18 and 49 (or 52% of the population in that age range). Accordingly, a large portion the U.S. population routinely carries some type of disposable lighter on their person. In regards to the non-smoking population, many people require the use of a lighter either at home or at work. For example, waiters are oftentimes required to light candles on tables or certain food dishes that are served flambé. In addition, many workers require the use of a lighter for a variety of tasks such as welding or general construction. Typically, women carry a disposable lighter in their purses and men oftentimes carry a lighter in a trouser or shirt pocket. Unfortunately, women often have a difficult time locating a small disposable lighter when carried in a full size purse because the lighter tends to become buried among various other loose articles in the purse. In regards to men, lighters tend to fall out of trouser or shirt pockets when sitting down or bending over, respectively.

Conventional devices for securing disposable lighters include an elastic cord or non-elastic chain for securing the lighter to an article of clothing worn by an individual. For example, U.S. Pat. No. 4,745,661 to Wainscott discloses a cord attachment for locating a cigarette lighter comprising an elastic cord connected at one end to a disk secured to the bottom end of a cigarette lighter and connected at an opposite end to a clip for attachment to clothing. Nevertheless, the device described in the Wainscott patent requires a specially configured lighter as compared to an "off-the-shelf" disposable lighter. As is well known to those skilled in the art, small disposable and relatively inexpensive lighters have become readily available on the current market, and have thus become quite popular. Specifically, the device of Wainscott requires the operator to glue or otherwise secure a disk with an opening for receiving the elastic cord onto the bottom of the lighter.

Further, U.S. Pat. No. 5,026,274 to Jacob describes a holding device for a lighter comprised of a reel mechanism contained within a housing wherein the housing includes a receiving well for seating a top portion of a disposable lighter. The device requires a hinged loop pivotally connected directly to the top of a lighter for attaching the lighter to a cord of the reel mechanism. The device described in the Jacob patent likewise requires a specially configured lighter wherein the lighter includes indentations for receiving the opposing open ends of the hinged loop.

These types of devices, as described above, require customized lighters including an attachment means for attaching the cord or chain to the lighter. Accordingly, the devices described above are not readily adaptable for use with conventional disposable lighters. Moreover, the prior art discloses holding devices, such as the receiving well of the Jacob patent, that require direct contact with or attachment to the disposable lighter. Stated differently, the devices disclosed in the prior art require a string, cord, or loop attached directly to the disposable lighter structure. Moreover, the cord or rigid loop of the patents described above tends to interfere with the lighting of a desired article.

Further, most elastic cords become stretched after prolonged use and dangle awkwardly from clothing. Thus, the user must stuff the excess cord into a pocket or purse, thereby presenting a sloppy appearance or adding to the bulkiness of a pocket or purse. In the case of chains, the excess portion allowing the user to draw the lighter to the item to be lit must likewise be placed in a pocket or purse when the lighter is not in use. Moreover, the excess portion of the chain or elastic cord is susceptible to becoming tangled in the person's clothing, hands, or other articles carried in the pocket or purse. To resolve the difficultly noted above, the housing of the present invention in combination with the advantageously shaped article holder allows the user to easily grasp the article holder securing the lighter, extract the article holder containing the lighter from a position adjacent the housing to a remote position proximate the cigarette or article to be lit (e.g., candle), light the desired item without interference from the holder, and then retract the lighter and the article holder to a position adjacent the housing.

In addition to cigarette lighters, a majority of the population typically carries other small items such as lipstick, writing instruments, or flashlights for use at work and around the house. These various small items likewise tend to become misplaced or lost when the items become buried in a purse or briefcase or fall out of the pocket when bending over or sitting down. Advantageously, the retractable article holder assembly of the present invention, and more particularly the article holder, can be readily adapted to secure items other than the cigarette lighters (e.g., lipstick or writing instrument) such that user may readily locate the article, extract the article holder containing the article from a position adjacent the housing to, for example, the mouth in the case of lipstick, apply the lipstick without interference from the article holder assembly, and subsequently retract the article holder to a position adjacent to the housing. Advantageously, an expended or empty article, for example, a lipstick case, can be easily removed from the holder and replaced with a new lipstick case because the lipstick or similar article—is not directly attached to the article holder assembly by the cord or chain.

OBJECT AND SUMMARY OF THE INVENTION

It is therefore an object of the present invention to provide an article holder configured to permit a user to light an item without interference from any part of the article holder assembly.

It is another object of the present invention to provide an article holder assembly for increasing the efficiency of locating and manipulating personal articles of a relatively small size.

Another object of the invention is to enhance the safety of operating a disposable cigarette lighter in the work environment.

Yet another object of the invention is to enhance the safety of operating cigarette lighters in a household environment by providing an article holder assembly for storing lighters out of reach of children.

A further object of the invention is to provide an assembly structure for reducing the likelihood of misplacing a small article.

Yet a further object of the invention is the provision of an article holder that is detachable from a housing containing a retraction mechanism, thereby promoting the interchangeability of article holders of different sizes and shapes for use in connection with the article holder assembly.

The invention meets these objectives with a retractable article holder assembly having an article holder for securing a personal article, a support housing, a clip for fastening the housing to an object, and a fastener strap for releasably securing the article holder to the housing. As configured, the article holder is capable of being extracted from a position adjacent the housing to a remote position in the vicinity of an item to be lit without interference from various components of the article holder assembly and subsequently retracted back to the position adjacent the housing. The article holder is detachable from the assembly and includes an integral tongue positioned to permit the manipulation of an item without interference from the remainder of the assembly. Specifically, a preferred embodiment of the retractable article holder assembly is comprised of an article holder having an open top end for receiving a disposable lighter, a closed bottom end, and an integral tongue extending beyond the top portion of the article holder. The tongue defines a slot for receiving a fastener strap that secures the article holder to one end of a housing containing a spring-biased reel mechanism. A cord secured at one end to the reel mechanism and at another end to the fastener snap promotes the extraction and retraction of the article holder.

The housing is provided with a clip thereby permitting the user to releasably attach the article holder to an article of clothing or a structure such as a dashboard, workbench, or wall. An alternative embodiment of the present invention includes a housing provided with hook and loop fasteners for attachment to corresponding hook and loop fasteners on an object or to material capable of engaging hook and loop fasteners (e.g., fabric covering furniture or the interior of a car).

It will be understood that the article holder may be formed of plastic, thermoplastic, metal, or textile material. The cord may be formed of textile material or plastic. The fastener strap may be formed of a flexible loop of plastic or textile material. A means for attaching opposing ends of the fastener strap to one another, and thus securing the article holder to the housing, may be formed of a snap tab, button arrangement, or Velcro™.

Advantageously, the detachable article holder allows the user to detach the article holder from the reel mechanism and replace the same with an article holder of a different size and shape, thereby allowing the operator to select a variety of items other than a disposable cigarette lighter for use in conjunction with the article holder assembly In sum, the advantages of the invention permit the user to light a desired item without interference from the article holder and promote the interchangeability of disposable cigarette lighters used in conjunction with the article holder assembly.

The foregoing and other objects and advantages of the invention and the manner in which the same are accomplished will become clearer based on the following detailed description taken in conjunction with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
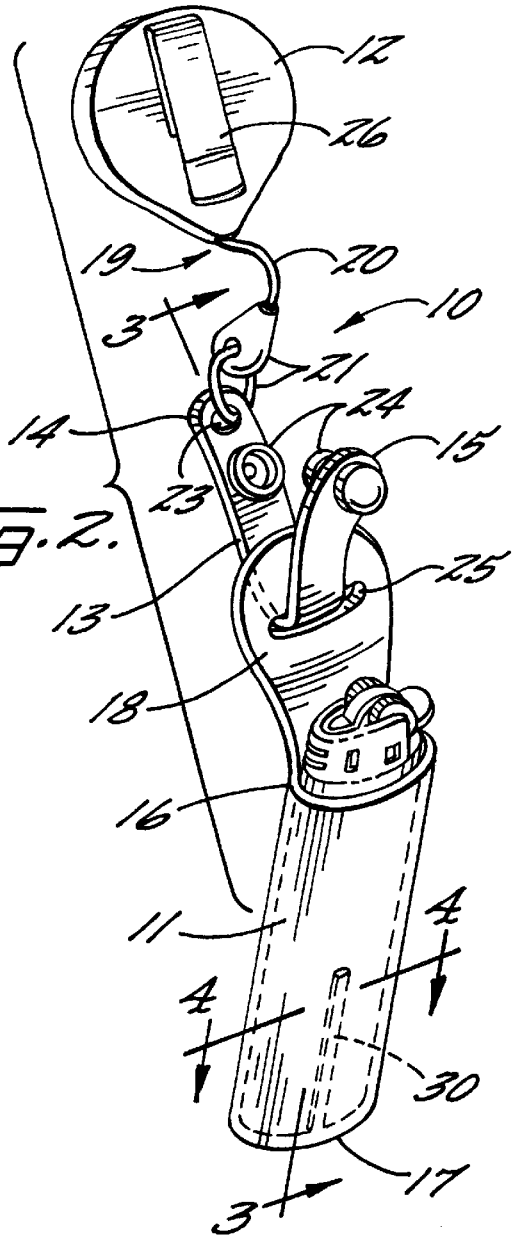
FIG. 2 is a perspective view of the invention illustrating the support housing, an article holder, a cigarette lighter contained within the article holder, and a means for connecting the article holder to the support housing.

An overall view of the article holder which incorporates features of the present invention is set forth in FIG. 2. As used herein, the designation "article" refers to any number of small articles capable of being received by the article holder such as a cigarette lighter, a tube of lipstick, a tube of lip balm, or writing instrument.

As illustrated in FIG. 2, the retractable article holder assembly 10 is comprised of an article holder 11, a support housing 12, a retraction means (not shown) mounted within the support housing, and a connecting means for connecting the article holder to the support housing. In a preferred embodiment, the connecting means is comprised of a fastener strap 13 having first and second ends 14, 15 for detachably securing the article holder 11 to the support housing 12. As depicted in the preferred embodiment of FIGS. 2 and 3, the article holder 11 is configured to conform to the shape of a disposable cigarette lighter and includes an open top end 16, a closed bottom end 17, and an integral tongue 18 extending beyond the open top end of the article holder.

The support housing 12 is comprised of first and second disks secured one to another in order to form a hollow chamber for supporting the retraction means. The retraction means is comprised of a spring-biased reel mechanism (not shown) secured to an interior portion of the support housing 12. The reel mechanism may include any number of conventional reel mechanisms used for extracting and retracting a pull-string or cord. The reel mechanism also includes a cord 20 secured at a first end to the reel mechanism. It will be understood that the reel mechanism and cord 20 form a reel and cord assembly: A second end of the cord 20 extends from the reel mechanism and through an opening 19 in the support housing 12. As illustrated in FIG. 2, the second end of the cord 20 supports a swivel means for connecting the fastener strap 13 to the housing 12. In the preferred embodiment, the swivel means is comprised of a bead and ring assembly 21 for promoting pivotal rotation of the article holder 11 relative to the housing 12 when the article holder is connected to the bead and ring assembly by the fastener strap 13. The bead of the bead and ring assembly 21 is secured to the second end of the cord 20 and defines an opening 20 for accepting at least a portion of the ring. Alternatively, the swivel means may be comprised of a swivel clasp secured to the second end of the cord 20.

The fastener strap also includes an opening 23 at its first end 14 for receiving the ring secured to the second end of the cord 20. The fastener strap 13 further comprises an attachment means for attaching the first and second ends of the strap 14, 15 to one another. In a first preferred embodiment of the present invention, the attachment means is comprised of corresponding male and female button snaps 24 positioned intermediate to the first and second strap ends 14, 15. In another preferred embodiment, the attachment means is comprised of corresponding hook and loop fasteners positioned intermediate to the first and second strap ends 14, 15.

The tongue 18 of the article holder defines a slot 25 positioned in spaced relationship from a top portion of an article (e.g., a cigarette lighter) secured in the article holder 11 for receiving at least a portion of the fastener strap 13. Advantageously, this configuration permits the article holder 11 to be releasably attached to the housing 12 when the second end 15 of the fastener strap 13 is advanced through the slot 25 on the tongue 18 and folded adjacent to the first end 14 of the strap, thereby positioning the button snaps 24 for corresponding engagement when pressed together (see FIG. 3). In an alternative embodiment, the corresponding hook and loop fasteners releasably attach the article holder 11 to the housing 12 when the second end 15 of the fastener strap 13 is advanced through the slot, folded adjacent to the first end 14, and pressed together at the ends. Accordingly, the retractable article holder assembly 10 permits the user to interchange article holders that will accommodate, for example, disposable lighters of varying sizes and shapes. In other words, the article holder 11 is interchangeable with the assembly 10 to accommodate lighters of varying sizes and shapes. In alternative embodiments, the assembly 10 permits the user to releasably attach an article holder configured to secure a variety of items such as lipstick or lip balm.

Figure 3:
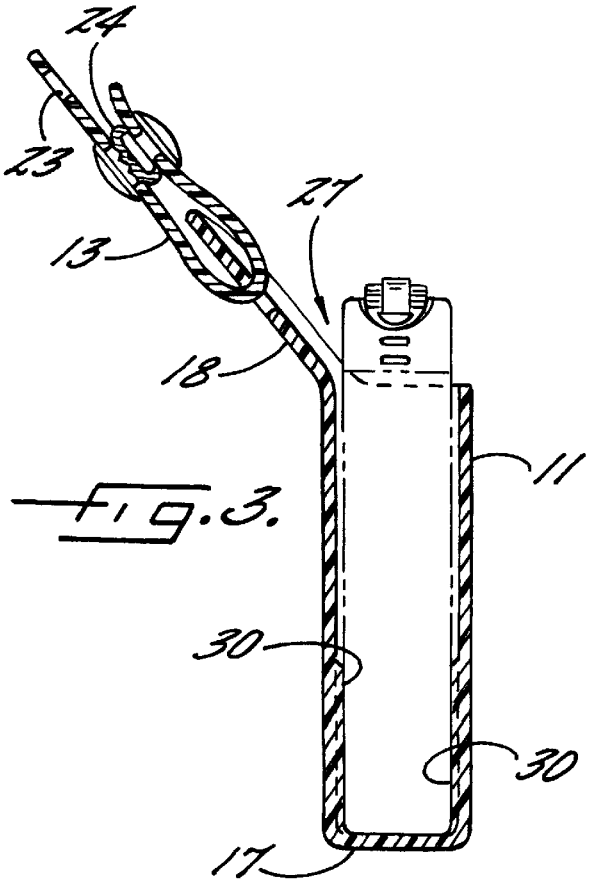
FIG. 3 is a cross-sectional view taken generally along lines 3—3 of FIG. 2.

As depicted in FIG. 3, the tongue 18 extends away from the open top end of the article holder 11 at an acute angle 27 relative to the longitudinal axis of the article holder. Thus, it is seen that the angle 27 of the tongue 18 permits the user to manipulate the article retained in the article holder without interference from the article holder 11. For example, the user can extract the article holder 11 and the secured cigarette lighter from a position adjacent the housing 12 and towards the mouth to light a cigarette without interference from the article holder when manipulating the flint wheel of the cigarette lighter, and thereafter retract the article holder to the original position adjacent the support housing.

The retractable article holder assembly further comprises means for releasably securing the support housing to an object wherein the securing means is positioned adjacent the support housing 12. In the preferred embodiment, the securing means is comprised of a self-biased clip 26 that is secured to the exterior of one of the discs forming the support housing 12. Thus, it is evident that the clip 26 can be attached to a belt, a shirt pocket, trouser pocket, or any number of objects having an edge or protruding lip (e.g., table, workbench, or windshield visor). It will also be understood that the securing means may include a spring-biased clip having teeth for clasping an article (not shown) and commonly referred to as "an alligator clip." In an alternative embodiment, the securing means may also include hook and loop fasteners positioned adjacent the support housing 12 for releasably securing the support housing to an object having corresponding hook and loop fasteners (e.g., hook and loop fasteners secured to a wall or work bench). Alternatively, the hook and loop fasteners adjacent the housing 12 may be attached to an object having a surface capable of engaging the hook and loop fasteners (e.g., cloth or similarly textured textile material).

Figure 4:
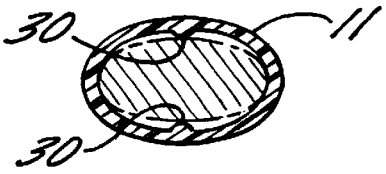
FIG. 4 is a longitudinal section view of the article holder taken generally along lines 4—4 of FIG. 2.

In order to restrain an article within the article holder 11, protrusions 30 are provided that extend outwardly from opposing interior walls of the article holder (see FIGS. 2, 3, and 4). Consequently, the protrusions 30 engage at least a portion of the exterior of an article that is advanced into the interior of the article holder 11. With reference to FIGS. 2 and 3, it will be apparent that the protrusions 30 will prevent movement of a cigarette lighter or other article relative to the article holder 11.

As illustrated in FIGS. 3 and 4, it will be understood that the protrusions 30 may comprise raised beads or ribs extending the length of at least a portion of the interior walls of the article holder 11. This advantageous feature of the present invention prevents the article from slipping out of the article holder 11 in a situation where the article holder assembly 10 is secured to a belt loop and exposed to a swinging motion during walking, sitting, and standing (see FIG. 1).

Figure 1:
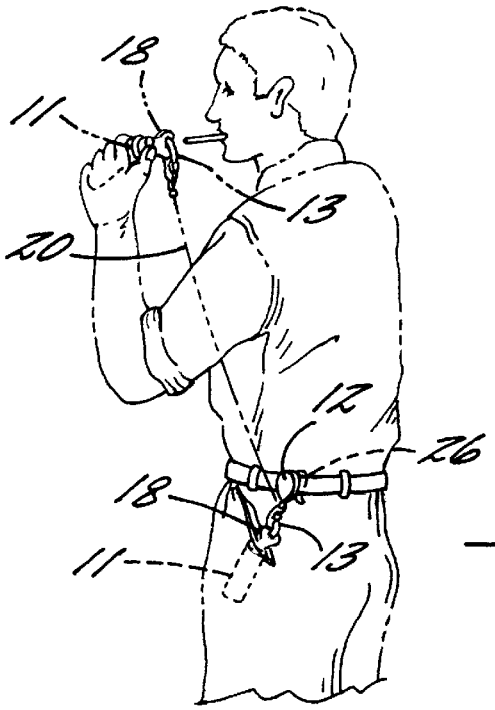
FIG. 1 is an environmental view of the retractable article holder assembly of the present invention in conjunction with a disposable cigarette lighter.

The operation of the retractable article holder assembly may be understood upon reference to FIG. 1, which illustrates a preferred use of the present invention. As depicted, the support housing 12 of the article holder assembly 10 is secured to a belt worn by the user, and the article holder 11 and portions of the fastener strap 13 rest within a trouser pocket. In preparation for lighting an item, the user grasps the article holder 11, extracts the article holder and attached cord 20 from a position adjacent the support housing 12 and trouser pocket towards the cigarette in the mouth. Attention is drawn to the fact that the position of the integral tongue 18 relative to the remainder of the article holder 11 permits the user to place his thumb on the flint wheel and manipulate the same without interference from the remaining components of the article holder assembly 10. It will also be appreciated that in the instance of employing the article holder 11 to retain a cigarette lighter, the flames projecting upwardly from the top of the lighter will not burn, singe, or melt any portion of the tongue 18 or fastener strap 13 as a result of the tongue extending away from the open top end of the article holder at an acute angle relative to the longitudinal axis of the article holder.

From the foregoing it will be seen that unique configuration of the reel and cord assembly, fastener strap 13, and article holder 11 into an article holder assembly 10 whereby the position of the slot 25 on the tongue 18 relative to the top of an article and the shape of the tongue relative to the longitudinal axis of the article holder overcomes problems associated with existing article holders. More specifically, the position of the slot 25 in spaced relation to the top of a lighter and the angle 27 of extension of the tongue 18 relative to the longitudinal axis of the article holder 11 prevents interference between the article being manipulated and the article holder assembly 10. Furthermore, it is evident that the protrusions 30 extending outwardly from the interior walls of the article holder 11 prevent an article from slipping from the same that would be expected with existing article holders. Moreover, the article holder 11 is interchangeable to conform with articles of varying sizes and shapes. Specifically, any disposable lighter can be used with the present invention without requiring an attachment device (e.g., loop or hinged clasp) configured for a particular lighter. Thus the user is not limited to the use of a specially configured lighter, but may use any disposable lighter available on the market in conjunction with the article holder assembly 10.

While the invention has been described in connection with a disposable cigarette lighter, one skilled in the art will appreciate that the invention is not necessarily so limited. As described herein, the article holder assembly 10 can be used in conjunction with any number of articles to include writing instruments, flashlights, or lipstick. Furthermore, one skilled in the art will appreciate that the invention is not necessarily limited for use in conjunction with a belt loop or pocket. To the contrary, the support housing 12 and associated securing means can be used to secure the article holder assembly 10 to any number of items such as a workbench, a windshield visor on a car, a desk drawer, a chair, or any other object that permits a secure connection with the securing means.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. A retractable article holder assembly for use in conjunction with a disposable cigarette lighter comprising in combination:

an article holder for securing a disposable cigarette lighter, said holder having a body conforming to the shape of a disposable cigarette lighter, an open top end, a closed bottom end, and an integral tongue extending beyond said open top end;

a support housing formed from first and second discs secured one to another to define a hollow chamber;

a fastener strap having first and second ends for detachably connecting said support housing to said article holder;

corresponding male and female button snaps positioned intermediate said first and second strap ends;

a spring-biased reel and cord assembly mounted within said hollow chamber for extracting and retracting said holder, said cord connected at a first end to said reel and at a second end to said fastener strap;

a clip associated with one of said support housing discs for attaching said housing to an object;

a swivel clasp connecting said cord and said second strap end, such that said swivel clasp promotes pivotal rotation of said holder relative to said housing;

said tongue defining a slot for receiving at least a portion of said fastener strap, said slot positioned in spaced relationship from a top end of the cigarette lighter secured in said article holder such that said article holder can be detachably connected to said housing when said second strap end is advanced through said slot and folded adjacent said first strap end, thereby positioning said corresponding male and female button snaps for engagement when pressed together;

whereby a user can extract said article holder and secured cigarette lighter from a position adjacent said housing to light an article and thereafter retract said article holder to said adjacent position.

2. A retractable article holder assembly comprising in combination:

an article holder for securing an article, said holder having an open top end, a closed bottom end, and an integral tongue extending beyond said open top end;

a support housing formed from first and second discs secured one to another to define a hollow chamber;

a retraction means mounted within said hollow chamber for extracting and retracting said article holder; and a means for detachably connecting said article holder to said retraction means, said connecting means comprising a fastener strap having first and second ends, one of said first and second fastener strap ends coupled to said retraction means, said fastener strap further comprising mateable coupling members positioned intermediate said ends of said fastener strap for detachably connecting said strap to said tongue of said article holder;

whereby said article holder can be withdrawn from and returned to a position adjacent said housing while remaining connected to said housing by said retraction means.

3. A retractable article holder assembly according to claim 2, wherein said tongue defines a slot positioned in spaced relationship from a top end of an article secured in said article holder for receiving at least a portion of said fastener strap.

4. A retractable article holder assembly according to claim 2, wherein said retraction means further comprises a spring-biased reel and cord, said cord connected at a first end to said reel and at a second end to said fastener strap.

5. A retractable article assembly according to claim 2, wherein said housing further comprises an opening for promoting the extraction and retraction of said cord from and into said housing.

6. A retractable article holder assembly according to claim 2, wherein said fastener strap further comprises an opening at said one of said first and second ends of said fastener strap for receiving a swivel clasp attached to said retraction means for promoting pivotal rotation of said article holder relative to said housing.

7. A retractable article holder assembly according to claim 2, wherein said attachment members comprise corresponding male and female button snaps.

8. A retractable article holder assembly according to claim 2, wherein said attachment members comprise corresponding hook and loop fasteners.

9. A retractable article holder assembly according to claim 3, wherein said article holder can be detachably connected to said housing when the other of said first and second fastener strap ends is advanced through said slot on said tongue and folded adjacent said one of said first and second fasteners strap ends, thereby positioning said attachment members for corresponding engagement when pressed together.

10. A retractable article holder assembly according to claim 2, further comprising a means for releasably securing said housing to an object, said securing means positioned adjacent one of said support housing discs.

11. A retractable article holder assembly according to claim 10, wherein said securing means further comprises a self-biased clip.

12. A retractable article holder assembly according to claim 10, wherein said securing means further comprises a spring-biased clip having teeth for clasping an article.

13. A retractable article holder assembly according to claim 10, wherein said securing means further comprises hook and loop fasteners.

14. A retractable article holder assembly according to claim 2, wherein said tongue extends away from said open top end at an acute angle relative to the longitudinal axis of said article holder, such that the angle of said tongue permits a user to manipulate the article retained in said article holder without interference from said holder.

15. A retractable article holder assembly according to claim 2, wherein said tongue is oval-shaped.

16. A retractable article holder assembly according to claim 2, wherein said tongue is fan-shaped.

17. A retractable article holder assembly according to claim 2, wherein said article holder is interchangeable with said assembly to accommodate articles of varying sizes and shapes.

18. A retractable article holder assembly according to claim 2, further comprising protrusions extending from interior portions of said article holder for engaging exterior portions of an article and preventing movement of the article relative to said article holder.

19. A retractable article holder assembly for use in conjunction with a disposable cigarette lighter comprising in combination:

an article holder for securing a disposable cigarette lighter, said holder having a body conforming to the shape of a disposable cigarette lighter, an open top end, a closed bottom end, and a shaped integral tongue extending beyond said open top end;

a support housing formed from first and second discs secured one to another to define a hollow chamber;

a fastener strap having first and second ends for detachably connecting to said holder, said first strap end including an opening;

a spring-biased reel and cord in connection with said support housing for extracting and retracting said holder, said cord secured at a first end to said reel and secured at a second end to said fastener strap;

a clip adjacent one of said support housing discs for attaching said housing to an object; and a bead and ring assembly for connecting said cord to said strap, said bead secured to said second cord end and defining an opening for accepting at least a portion of said ring passing through said fastener strap opening, such that said bead and ring promotes pivotal rotation of said article holder relative to said housing;

wherein an operator can extract said article holder and secured cigarette lighter from a position adjacent said housing to light an item and thereafter retract said article holder to said adjacent position.

20. A retractable article holder assembly for use in conjunction with a disposable cigarette lighter according to claim 19, wherein said tongue defines a slot for receiving at least a portion of said fastener strap, said slot positioned in spaced relationship from a top end of a cigarette lighter secured in said holder, such that said article holder can be detachably connected to said housing when said second strap end is advanced through said slot and folded adjacent said first strap end, thereby positioning corresponding male and female button snaps positioned intermediate said first and second strap ends for engagement when pressed together.

21. A retractable article holder assembly for use in conjunction with a disposable cigarette lighter according to claim 19, wherein said tongue is oval-shaped.

22. A retractable article holder assembly for use in conjunction with a disposable cigarette lighter according to claim 19, wherein said tongue is fan-shaped.

23. A retractable article holder assembly for use in conjunction with a disposable cigarette lighter according to claim 19, wherein said tongue extends away from said open top end at an acute angle relative to the longitudinal axis of said article holder, such that the angle of said tongue permits a user to activate the cigarette lighter and light an item without interference from said holder.

24. A retractable article holder assembly for use in conjunction with a disposable cigarette lighter according to claim 19, wherein said article holder is interchangeable with said assembly to accommodate disposable lighters of varying sizes and shapes.

25. A retractable article holder assembly for use in conjunction with a disposable cigarette lighter according to claim 19, further comprising protrusions extending from interior portions of said article holder for engaging exterior portions of a cigarette lighter and preventing movement of the cigarette lighter relative to said holder.

26. A retractable article holder assembly for use in conjunction with a disposable cigarette lighter comprising in combination:

an article holder for securing a disposable cigarette lighter, said holder having an open top end, a closed bottom end, and an integral tongue extending beyond said open top end;

a support housing for releasably securing said holder to an object;

hook and loop fasteners adjacent said housing for securing said housing to an object;

a spring-biased reel and cord assembly mounted within said housing for extracting and retracting said article holder from and to a position adjacent said housing;

a fastener strap having first and second ends for detachably connecting said reel and cord assembly to said tongue of said article holder, one of said ends of said fastener strap being connected to said reel and cord assembly; and corresponding male and female button snaps positioned intermediate said first and second strap ends for detachably connecting said fastener strap to said tongue.

27. A retractable article holder assembly for use in conjunction with a disposable cigarette lighter according to claim 26, further comprising a swivel clasp connecting said reel and cord assembly and said fastener strap for promoting pivotal rotation to said article holder relative to said housing.

28. A retractable article holder assembly for use in conjunction with a disposable cigarette lighter according to claim 26, wherein said tongue extends away from said open top end at an acute angle relative to the longitudinal axis of said article holder, such that the angle of said tongue permits an operator to activate the cigarette lighter and light an item without interference from said holder.

29. A retractable article holder assembly for use in conjunction with a disposable cigarette lighter according to claim 26, wherein said article holder further comprises protrusions extending from interior portions of said holder for engaging exterior portions of the cigarette lighter and preventing movement of the cigarette lighter relative to said article holder.

30. A retractable article holder assembly for use in conjunction with a disposable cigarette lighter according to claim 26, wherein said tongue defines a slot for receiving at least a portion of said fastener strap, said slot positioned in spaced relationship from a top end of the cigarette lighter secured in said article holder, such that said article holder can be detachably connected to said housing when the other of said fastener strap ends is advanced through said slot and folded adjacent said one of said strap ends, thereby positioning said corresponding male and female button snaps for engagement when pressed together;

wherein an operator can extract said article holder and secured cigarette lighter from a position suspended below or adjacent said retraction mechanism to light an item and thereafter retract said article holder to said adjacent position.

* * * * *

UNITED STATES PATENT AND TRADEMARK OFFICE

CERTIFICATE OF CORRECTION

PATENT NO. : 6,382,481 B1
DATED : May 7, 2002
INVENTOR(S) : Caroline Jo McIlmoil It is certified that error appears in the above-identified patent and that said Letters Patent is hereby corrected as shown below:

Column 10,
Line 33, delete "to" and substitute -- of -- therefore.

Signed and Sealed this

Fifteenth Day of October, 2002

*Attest:*

*Attesting Officer*

JAMES E. ROGAN
*Director of the United States Patent and Trademark Office*